US008947470B2

(12) United States Patent
Jang et al.

(10) Patent No.: US 8,947,470 B2
(45) Date of Patent: Feb. 3, 2015

(54) METHOD OF CONTROLLING BACKLIGHT DEVICE AND DISPLAY APPARATUS USING THE SAME

(75) Inventors: Dae-Gwang Jang, Incheon (KR); Tae Kwon Jung, Asan-si (KR); Donghak Pyo, Cheonan-si (KR); Min Ha Keum, Cheonan-si (KR); Hak-Mo Choi, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 601 days.

(21) Appl. No.: 13/181,148

(22) Filed: Jul. 12, 2011

(65) Prior Publication Data

US 2012/0162276 A1 Jun. 28, 2012

(30) Foreign Application Priority Data

Dec. 23, 2010 (KR) ..... 10-2010-0133491

(51) Int. Cl.
*G09G 5/10* (2006.01)
*G09G 3/34* (2006.01)

(52) U.S. Cl.
CPC ..... *G09G 3/3426* (2013.01); *G09G 2320/0626* (2013.01); *G09G 2360/16* (2013.01)
USPC ..... 345/690; 345/12; 345/63; 345/77; 345/89

(58) Field of Classification Search
CPC ..... G09G 2360/16; G09G 3/3648
USPC ..... 345/12, 63, 77, 89, 581; 340/815.55; 358/1.9–3.32
See application file for complete search history.

(56) References Cited

U.S. PATENT DOCUMENTS

| | | | | |
|---|---|---|---|---|
| 2006/0109234 | A1* | 5/2006 | Hong et al. | 345/102 |
| 2009/0140665 | A1* | 6/2009 | Park | 315/291 |
| 2010/0141155 | A1* | 6/2010 | Hong et al. | 315/152 |
| 2011/0090262 | A1* | 4/2011 | Kim | 345/690 |

FOREIGN PATENT DOCUMENTS

| | | |
|---|---|---|
| JP | 2008-203292 | 9/2008 |
| KR | 1020100033731 | 3/2010 |
| KR | 1020100048391 | 5/2010 |

* cited by examiner

*Primary Examiner* — Gerald Johnson
(74) *Attorney, Agent, or Firm* — F. Chau & Associates, LLC

(57) ABSTRACT

In a display apparatus, a display panel is divided into dimming areas and a backlight device includes light source blocks providing light to the dimming areas. Average gray-scale values and maximum gray-scale values respectively corresponding to the dimming areas are generated based on image signals provided to the dimming areas. Whether the average gray-scale values and the maximum gray-scale values are respectively within first and second reference ranges are checked. One of at least two parameters is selected according to a checked result, and representative brightness values respectively corresponding to the dimming areas are determined using the selected parameter. Duty ratios of the light source blocks are controlled based on the representative brightness values. As a result, power consumption is reduced when applying a dimming device to the display apparatus.

18 Claims, 9 Drawing Sheets

METHOD OF CONTROLLING BACKLIGHT DEVICE AND DISPLAY APPARATUS USING THE SAME

CROSS-REFERENCE TO RELATED APPLICATION

This application claims priority to Korean Patent Application No. 10-2010-0133491 filed on Dec. 23, 2010, the contents of which are herein incorporated by reference in its entirety.

BACKGROUND

1. Technical Field

The present invention relates to a method of controlling a backlight device and a display apparatus using the same. More particularly, the present invention relates to a method of controlling a backlight device capable of reducing power consumption and a display apparatus using the same.

2. Discussion of the Related Art

A liquid crystal display includes a liquid crystal display panel controlling a light transmittance of liquid crystal molecules to display an image and a backlight assembly arranged under the liquid crystal display panel to provide light to the liquid crystal display panel. The backlight assembly includes a light source generating light.

Local dimming driving methods have been developed in which a light source is divided into a plurality of light source blocks the amount of light of which is controlled responsive to a brightness of part of an image corresponding to each of the light source blocks to minimize power consumption and to prevent a contrast ratio of the image from being decreased.

SUMMARY

Exemplary embodiments of the present invention provide a method of dimming a backlight device capable of reducing power consumption and a display apparatus using the dimming method.

According to an exemplary embodiment, there is provided a method of controlling a backlight device comprising a plurality of light source blocks respectively corresponding to a plurality of dimming areas of a display panel. The method includes outputting average grayscale values and maximum grayscale values for the respective dimming areas based on image signals provided to the display panel, outputting result signals determining whether the average grayscale values are within a predetermined first reference range and whether the maximum grayscale values are within a predetermined second reference range, outputting representative brightness values for the respective dimming areas based on a parameter selected from predetermined two or more parameters, wherein the selected parameter is based on the result signals, and determining duty ratios of the respective light source blocks based on the representative brightness values.

According to an exemplary embodiment, a backlight device includes a plurality of light source blocks that provide light to a display panel divided into a plurality of dimming areas. The backlight device controls duty ratios of the light source blocks using image signals provided to each of the dimming areas. A method of dimming the backlight device is provided according to an embodiment.

A plurality of gray-scale values is extracted from the image signals. Average values of the gray-scale values are calculated to generate average gray-scale values respectively corresponding to the dimming areas, and maximum values of the gray-scale values are extracted to generate maximum gray-scale values respectively corresponding to the dimming areas.

Then, whether the average gray-scale values are within a predetermined first reference range is checked and whether the maximum gray-scale values are within a predetermined second reference range is checked.

One of at least two parameters is selected according to a checked result, and representative brightness values respectively corresponding to the dimming areas are determined using the selected parameter.

Dimming signals are output based on the representative brightness values to determine the duty ratios of the light source blocks, and the light source blocks are driven in response to the dimming signal.

According to an exemplary embodiment, a display apparatus includes a display panel divided into a plurality of dimming areas, a backlight device including a plurality of light source blocks, each having a plurality of light sources to provide light to the display panel, wherein the plurality of light source blocks respectively correspond to the dimming areas, a dimming device outputting dimming signals to control duty ratios of the light source blocks corresponding to the dimming areas, respectively, using image signals provided to each of the dimming areas, and a light source driver outputting driving signals to the light source blocks based on the dimming signals.

The dimming device includes an average/maximum gray-scale value generator, a comparing/checking part, a representative brightness value deciding part, and a dimming signal generator.

The average/maximum gray-scale value generator extracts a plurality of gray-scale values from the image signals, calculates average values of the gray-scale values to generate average gray-scale values of the dimming areas, and extracts maximum values of the gray-scale values to generate maximum gray-scale values of the dimming areas.

The comparing/checking part checks whether the average gray-scale values are within a predetermined first reference range and checks whether the maximum gray-scale values are within a predetermined second reference range.

The representative brightness value deciding part selects one of at least two parameters according to a checked result and determines representative brightness values corresponding to the dimming areas using the selected parameter.

The dimming signal generator outputs the dimming signals to determine the duty ratios of the light source blocks based on the representative brightness values.

The number of average gray-scale values departing from a first reference range determined based on an average value of the average gray-scale values respectively corresponding to the dimming areas and the number of maximum gray-scale values departing from a second reference range determined based on an average value of the maximum gray-scale values respectively corresponding to the dimming areas are checked. Then, one of at least two parameters is selected according to a checked result, and the representative brightness values respectively corresponding to the dimming areas are determined using the selected parameter.

Thus, the representative brightness values respectively corresponding to the dimming areas may be prevented from being set to an excessively high level, thereby reducing power consumption in the display apparatus adopting the dimming method.

BRIEF DESCRIPTION OF THE DRAWINGS

The embodiments of the present invention will become readily apparent by reference to the following detailed description when considered in conjunction with the accompanying drawings wherein.

DETAILED DESCRIPTION

It will be understood that when an element or layer is referred to as being "on", "connected to" or "coupled to" another element or layer, it can be directly on, connected or coupled to the other element or layer or intervening elements or layers may be present. Like numbers may refer to like or substantially like elements throughout the drawings and the specification.

Figure 1:
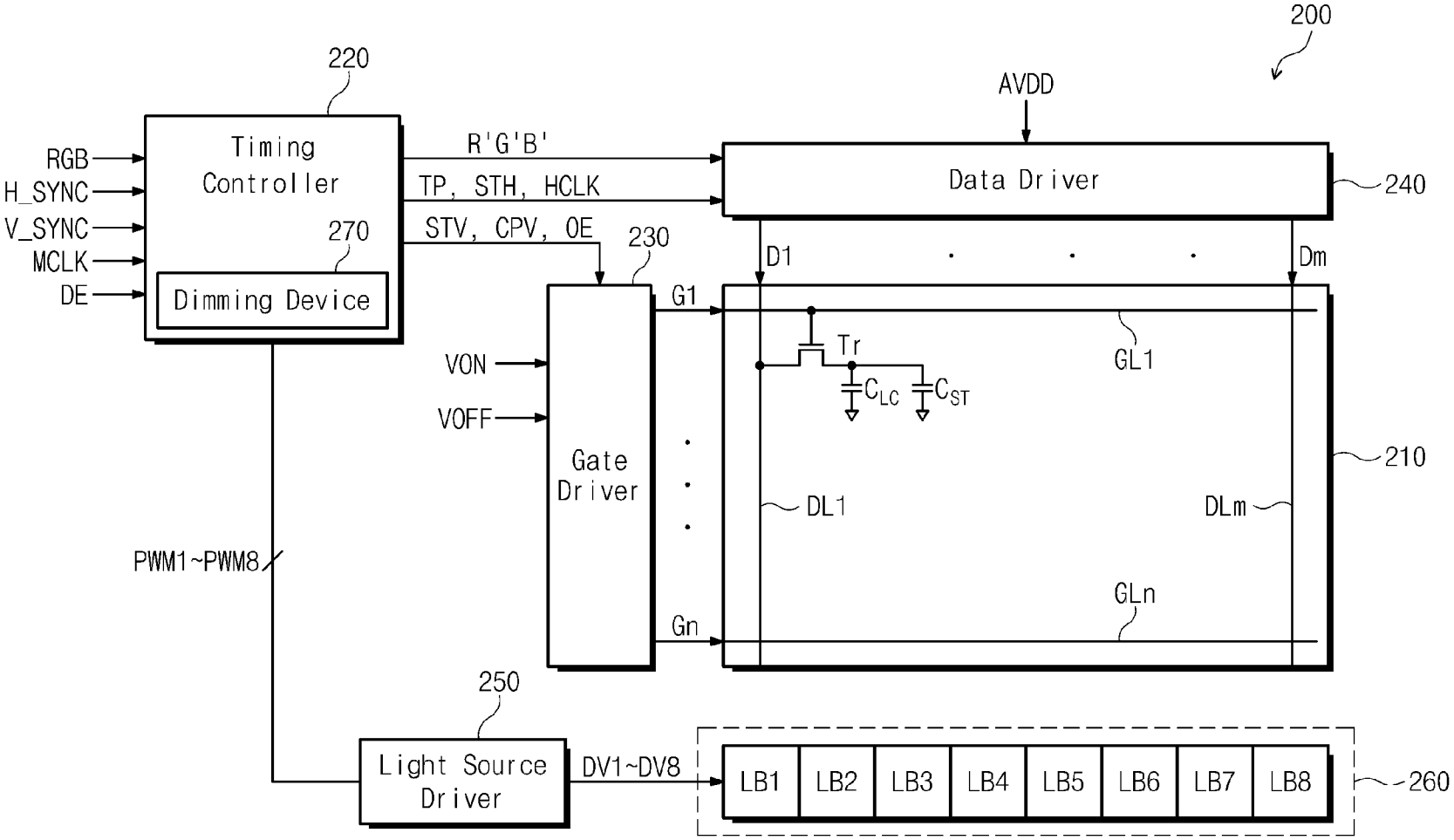
FIG. 1 is a block diagram showing a liquid crystal display according to an exemplary embodiment of the present invention.
Figure 2:
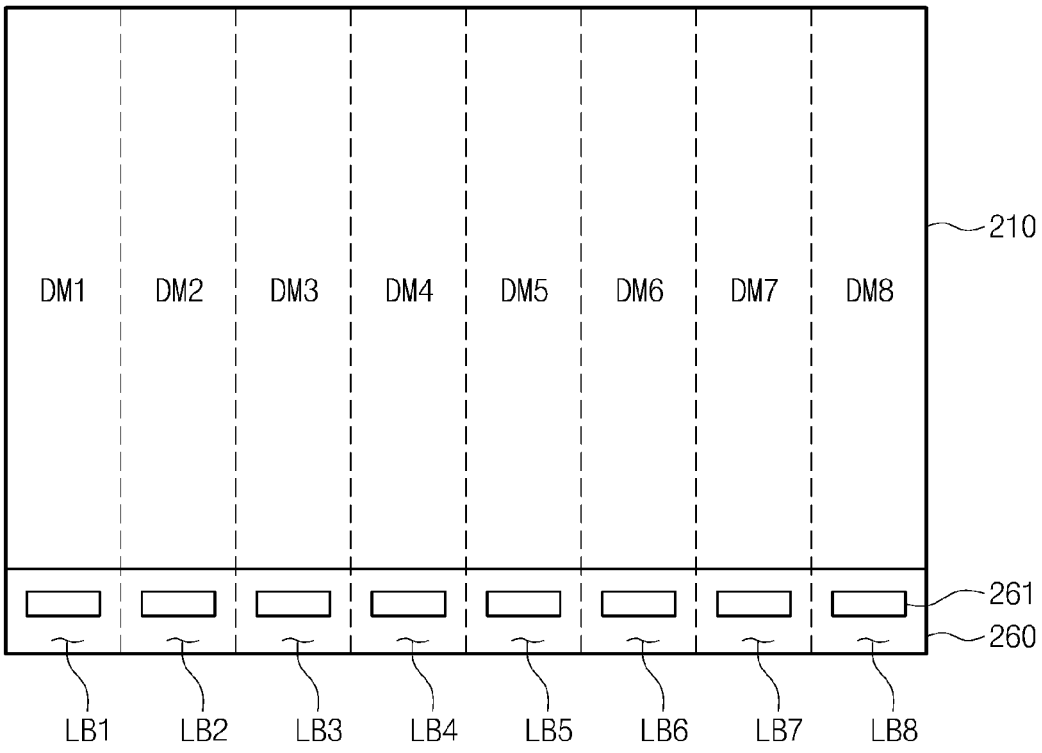
FIG. 2 is a plan view showing a correspondence relation between the liquid crystal display panel and the backlight device of FIG. 1.

FIG. 1 is a block diagram showing a liquid crystal display according to an exemplary embodiment of the present invention, and FIG. 2 is a plan view showing a correspondence relation between the liquid crystal display panel and the backlight device of FIG. 1.

Referring to FIG. 1, a liquid crystal display 200 includes a liquid crystal display panel 210, a timing controller 220, a gate driver 230, a data driver 240, a light source driver 250, and a backlight device 260.

The liquid crystal display panel 210 includes a plurality of gate lines GL1~GLn, a plurality of data lines DL1~DLm crossing the gate lines GL1~GLn, and a plurality of pixels respectively arranged at areas defined by the gate lines GL1~GLn and the data lines DL1~DLm. As shown in FIG. 1, for convenience of description, one pixel is described in detail as a representative example. Each pixel includes a thin film transistor Tr having a gate electrode connected to a corresponding gate line, a source electrode connected to a corresponding data line, a liquid crystal capacitor $C_{LC}$ connected to a drain electrode of the thin film transistor Tr, and a storage capacitor $C_{ST}$ connected to the drain electrode of the thin film transistor Tr.

The timing controller 220 receives an image signal RGB, a horizontal synchronization signal H_SYNC, a vertical synchronization signal V_SYNC, a clock signal MCLK, and a data enable signal DE from an external device (not shown). The timing controller 220 converts a data format of the image signal RGB to be suited for an interface between the timing controller 220 and the data driver 240 and provides the converted image signal R'G'B' to the data driver 240. Also, the timing controller 220 provides data control signals, such as an output start signal TP, a horizontal start signal STH, and a clock signal HCLK, to the data driver 240 and provides gate control signals, such as a vertical start signal STV, a gate clock signal CPV, and an output enable signal OE, to the gate driver 230.

The gate driver 230 receives a gate-on voltage VON and a gate-off voltage VOFF and sequentially outputs gate signals G1~Gn having the gate-on voltage VON in response to the gate control signals STV, CPV, and OE provided from the timing controller 220. The gate signals G1~Gn are sequentially applied to the gate lines GL1~GLn of the liquid crystal display panel 210 to sequentially scan the gate lines GL1~GLn. Although not shown in FIGS. 1 and 2, according to an embodiment, the liquid crystal display 200 may further include a regulator that converts an input voltage to the gate-on voltage VON and the gate-off voltage VOFF and outputs the gate-on voltage VON and the gate-off voltage VOFF.

The data driver 240 is driven in response to an analogue driving voltage AVDD and generates a plurality of gray-scale voltages using gamma voltages provided from a gamma voltage generator (not shown). The data driver 240 selects gray-scale voltages corresponding to the image signal R'G'B' among the generated gray-scale voltages in response to the data control signals TP, STH, and HCLK and provides the selected gray-scale voltages to the data lines DL1~DLm of the liquid crystal display panel 210 as data signals D1~Dm.

When the gate signals G1~Gn are sequentially applied to the gate lines GL1~GLn, the data signals D1~Dm are applied to the data lines DL1~DLm in synchronization with the gate signals G1~Gn. When a corresponding gate signal is applied to a selected gate line, a thin film transistor Tr connected to the selected gate line is turned on in response to the corresponding gate signal. When a data signal is applied to a data line connected to the turned-on thin film transistor Tr, the applied data signal is charged to the liquid crystal capacitor $C_{LC}$ and the storage capacitor $C_{ST}$ through the turned-on thin film transistor Tr.

The liquid crystal capacitor $C_{LC}$ controls a light transmittance of liquid crystal molecules according to the charged voltage. The storage capacitor $C_{ST}$ is charged with the data signal when the thin film transistor Tr is turned on and applies the charged data signal to the liquid crystal capacitor $C_{LC}$ when the thin film transistor Tr is turned off to maintain the charged state of the liquid crystal capacitor $C_{LC}$. Through the above described process, the liquid crystal display panel 210 displays an image.

The backlight device 260 includes a plurality of light source blocks. According to an exemplary embodiment, a plurality of light sources are divided into eight light source blocks (hereinafter, referred to as "first to eighth light source blocks LB1~LB8") in the backlight device 260.

As shown in FIG. 2, the liquid crystal display panel 210 is divided into first to eighth dimming areas DM1~DM8 respectively corresponding to the first to eighth light source blocks LB1~LB8 of the backlight device 260. According to an embodiment, the number of dimming areas defined in the liquid crystal display panel 210 may depend upon the number of light source blocks. As an example, when the backlight device 260 includes twelve light source blocks, the liquid crystal display panel 210 may be divided into twelve dimming areas.

As shown in FIG. 2, the first to eighth light source blocks LB1~LB8 are arranged adjacent to a lower portion of one end of the liquid crystal display panel 210. The liquid crystal display panel 210 are divided into the first to eighth dimming areas DM1~DM8 along a direction in which the first to eighth light source blocks LB1~LB8 are arranged.

Each of the first to eighth light source blocks LB1~LB8 includes at least one light source 261. According to an embodiment, the light source 261 may be a light emitting diode. As shown in FIG. 2, each of the first to eighth light source blocks LB1~LB8 includes only one light emitting diode. According to an embodiment, however, the number of the light emitting diodes arranged in each of the first to eighth light source blocks LB1~LB8 may be changed.

When adopting a local dimming method, the amount of light emitted from each of the first to eighth light source blocks LB1~LB8 is controlled by changing a duty ratio or a level of a driving signal applied to each of the first to eighth light source blocks LB1~LB8. As a result, the first to eighth dimming areas DM1~DM8 of the liquid crystal display panel 210 receive light having different intensities from each other.

The liquid crystal display 200, which adopts the local dimming method, further includes a dimming device 270 to control the duty ratio or the level of the driving signal applied to each of the first to eighth light source blocks LB1~LB8.

According to an exemplary embodiment, the dimming device 270 may be included in the timing controller 270, but the embodiments of the present invention should not be limited thereto or thereby. For example, according to an embodiment, the dimming device 270 may be arranged as a separate device from the timing controller 220.

The dimming device 270 receives the image signal R'G'B' and generates first to eighth dimming signals PWM1~PWM8 based on the image signal R'G'B'. The first to eighth dimming signals PWM1~PWM8 are provided to the light source driver 250. The light source driver 250 controls the duty ratio or the level of first to eighth driving signals DV1~DV8 respectively applied to the first to eighth light source blocks LB1~LB8 based on the first to eighth dimming signals PWM1~PWM8.

Figure 3:
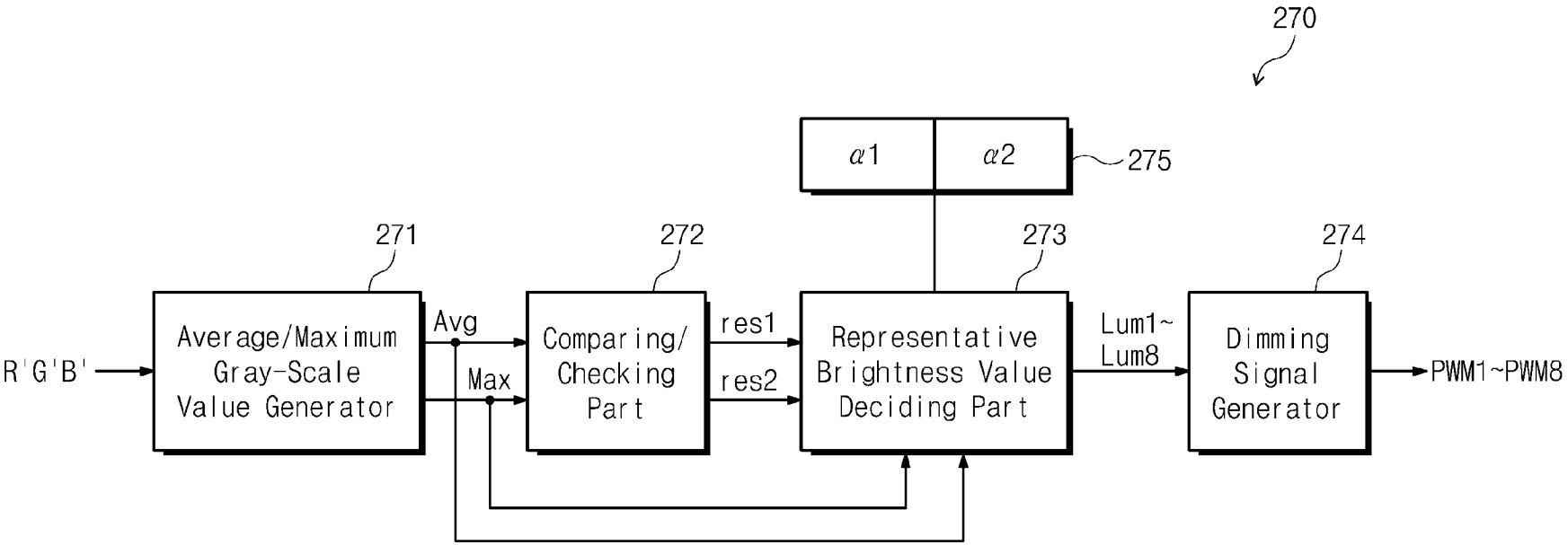
FIG. 3 is a block diagram showing a dimming device according to an exemplary embodiment of the present invention.

FIG. 3 is a block diagram showing a dimming device according to an exemplary embodiment of the present invention.

Referring to FIG. 3, the dimming device 270 includes an average/maximum gray-scale value generator 271, a comparing/checking part 272, a representative brightness value deciding part 273, and a dimming signal generator 274.

The average/maximum gray-scale value generator 271 receives the image signal R'G'B' generated from the timing controller 220 and divides the image signal R'G'B' into image signal groups respectively corresponding to the first to eighth dimming areas DM1~DM8. The average/maximum gray-scale value generator 271 extracts a plurality of gray-scale values from each of the image signal groups, calculates an average value of the gray-scale values, and generates average gray-scale values Avg respectively corresponding to the first to eighth dimming areas DM1~DM8.

The average/maximum gray-scale value generator 271 outputs maximum gray-scale values Max, each of which is extracted as a maximum value of gray-scale values from each of the image signal groups, to the first to eighth dimming areas DM1~DM8.

The comparing/checking part 272 checks whether the average gray-scale values Avg are within a predetermined first reference range. According to an embodiment, the first reference range may be set based on a second average value obtained by calculating an average of the average gray-scale values Avg. As a consequence, the first reference range may be changed according to a level of the average gray-scale values Avg.

The comparing/checking part 272 calculates the number of the average gray-scale values Avg departing from the first reference range and checks whether the number of the average gray-scale values Avg departing from the first reference range exceeds a predetermined first reference number. The comparing/checking part 272 transmits a checked result to the representative brightness value deciding part 273. The comparing/checking part 272 outputs a first result signal res1 that indicates whether the number of the average gray-scale values departing from the first reference range exceeds the first reference number. According to an embodiment, the first result signal res1 may be a two-phase signal to indicate whether the number of the average gray-scale values Avg departing from the first reference range exceeds the first reference number. For example, according to an embodiment, the comparing/checking part 272 may output the first result signal res1 in a high state when the number of the average gray-scale values Avg departing from the first reference range exceeds the first reference number and may output the first result signal res1 in a low state when the number of the average gray-scale values Avg departing from the first reference range does not exceed the first reference number.

Also, the comparing/checking part 272 checks whether the maximum gray-scale values Max are within a predetermined second reference range. According to an embodiment, the second reference range may be set based on a third average value obtained by calculating an average of the maximum gray-scale values Max. As a consequence, the second reference range may be changed according to a level of the maximum gray-scale values Max.

The comparing/checking part 272 calculates the number of the maximum gray-scale values Max departing from the second reference range and checks whether the number of the maximum gray-scale values departing from the second reference range exceeds a predetermined second reference number. The comparing/checking part 272 transmits a checked result to the representative brightness value deciding part 273. The comparing/checking part 272 outputs a second result signal res2 indicating whether the number of maximum gray-scale values Max departing from the second reference range exceeds the second reference number. According to an embodiment, the second result signal res2 may be a two-phase signal indicating whether the number of maximum gray-scale values Max departing from the second reference range exceeds the second reference number. For example, according to an embodiment, the comparing/checking part 272 outputs the second result signal res2 in a high state when the number of the maximum gray-scale values departing from the second reference range exceeds the second reference number and outputs the second result signal res2 in a low state when the number of the maximum gray-scale values departing from the second reference range does not exceed the second reference number.

The representative brightness value deciding part 273 selects one of at least two parameters according to the first and second result signals res1 and res2 and generates first to eighth representative brightness values Lum1~Lum8 respectively corresponding to the first to eighth dimming areas DM1~DM8 using the selected parameters.

According to an exemplary embodiment, the dimming device 270 further includes a first storing part 275 to store a first parameter α1 and a second parameter α2. According to an embodiment, the dimming device 270 may use a portion of an EEPROM included in the timing controller 220 as the first storing part 275 to store the first parameter α1 and the second parameter α2.

For example, when at least one of the first and second result signals res1 and res2 is in the high state, the representative brightness value deciding part 273 selects the first parameter α1 having a larger value than a value of the second parameter α2. When both of the first and second result signals res1 and res2 are in the low state, the representative brightness value deciding part 273 selects the second parameter α2 having a smaller value than a value of the first parameter α1.

The representative brightness value of each of the dimming areas satisfies the following Equation 1:

$$Lum=Avg+(Max-Avg)\times\alpha \quad \text{[Equation 1]}$$

In the above Equation 1, Avg denotes the average gray-scale value of each of the dimming areas, Max denotes the maximum gray-scale value of each of the dimming areas, and a denotes the selected parameter. For example, according to an embodiment, a may be the first parameter α1 or the second parameter α2. Each of the first and second parameters α1 and a2 is larger than 0 and smaller than 1.

The first to eighth representative brightness values Lum1~Lum8 respectively corresponding to the first to eighth dimming areas DM1~DM8 calculated through the above process are provided to the dimming signal generator 274.

The dimming signal generator 274 outputs the first to eighth dimming signals PWM1~PWM8 based on the first to eighth representative brightness values Lum1~Lum8 to control duty ratios of light sources included in each of the first to eighth dimming areas DM1~DM8.

The light source driver 250 (shown in FIG. 1) generates the first to eighth driving signals DV1~DV8 to control the duty ratios of the first to eighth light source blocks LB1~LB8 according to the first to eighth dimming signals PWM1~PWM8.

Figure 4A:
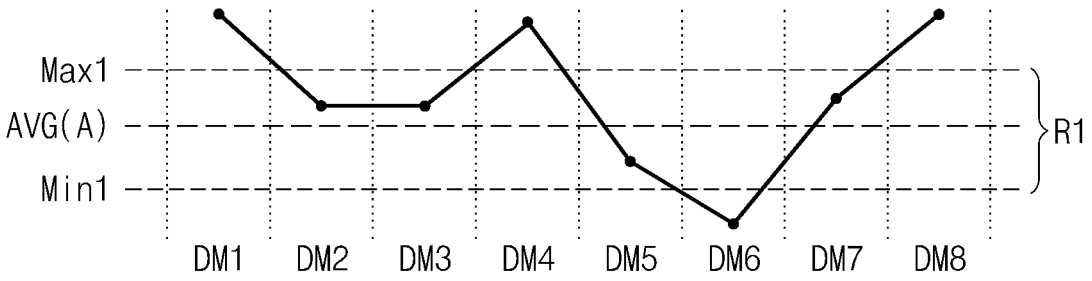
FIG. 4A is a graph showing average gray-scale values of first to eighth dimming areas according to an exemplary embodiment of the present invention.
Figure 4B:
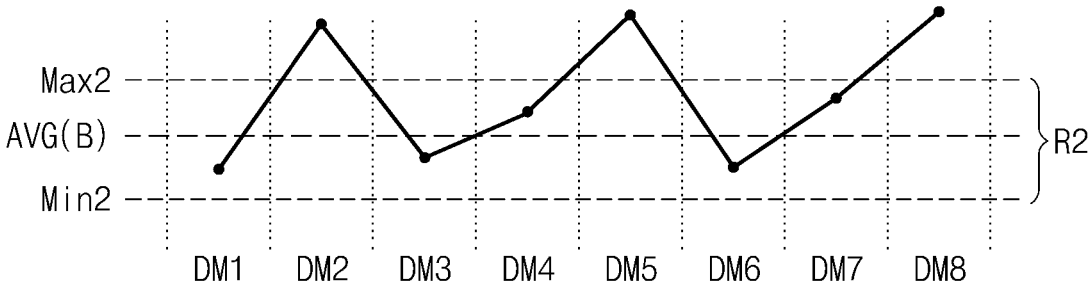
FIG. 4B is a graph showing maximum gray-scale values of first to the eighth dimming areas according to an exemplary embodiment of the present invention.

FIG. 4A is a graph showing the average gray-scale values of the first to eighth dimming areas according to an exemplary embodiment of the present invention, and FIG. 4B is a graph showing the maximum gray-scale values of the first to eighth dimming areas according to an exemplary embodiment of the present invention.

The average gray-scale values respectively corresponding to the first to eighth dimming areas DM1~DM8 have been shown in FIG. 4A. A first reference range R1 is set based on an average AVG(A) of the average gray-scale values of the first to eighth dimming areas DM1~DM8. For example, when a second average value AVG(A) corresponding to the average of the average gray-scale values of the first to eighth dimming areas DM1~DM8 is calculated, a value that is larger than the second average value AVG(A) by a reference value is set as a maximum value Max1 of the first reference range R1 and a value that is smaller than the second average value AVG(A) by the reference value is set as a minimum value Min1 of the first reference range R1.

As shown in FIG. 4A, four of the average gray-scale values of the first to eighth dimming areas DM1~DM8 depart from the first reference range R1. When a reference number is set to three, the comparing/checking part 272 outputs the first result signal res1 in the high state.

Referring to FIG. 4B, a second reference range R2 is set based on an average AVG(B) of the maximum gray-scale values of the first to eighth dimming areas DM1~DM8. For example, when a third average value AVG(B), which corresponds to the average of the maximum gray-scale values of the first to eighth dimming areas DM1~DM8, is calculated, a value that is larger than the third average value AVG(B) by a reference value is set as a maximum value Max2 of the second reference range R2 and a value that is smaller than the third average value AVG(B) by the reference value is set as a minimum value Min2 of the second reference range.

As shown in FIG. 4B, three of the maximum gray-scale values of the first to eighth dimming areas DM1~DM8 depart from the second reference range R2. When a reference number is set as three, the comparing/checking part 272 outputs the second result signal res2 in a low state.

When at least one of the first and second result signals res1 and res2 is in the high state, the representative brightness value deciding part 273 calculates the first to eighth representative brightness values Lum1~Lum8 using the first parameter α1 having a value larger than a value of the second parameters α2.

Figure 5A:
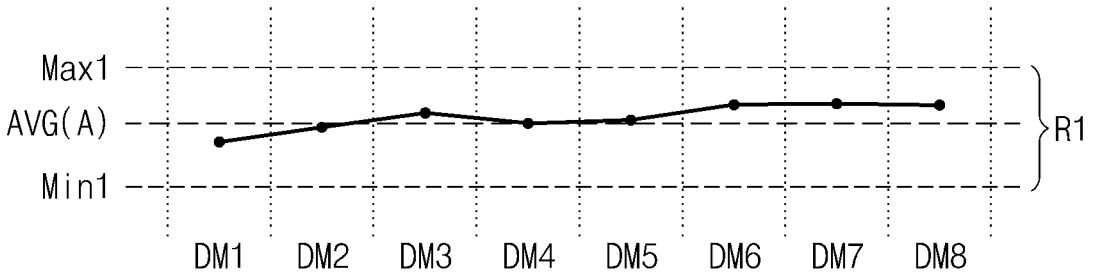
FIG. 5A is a graph showing average gray-scale values of first to eighth dimming areas according to an exemplary embodiment of the present invention.
Figure 5B:
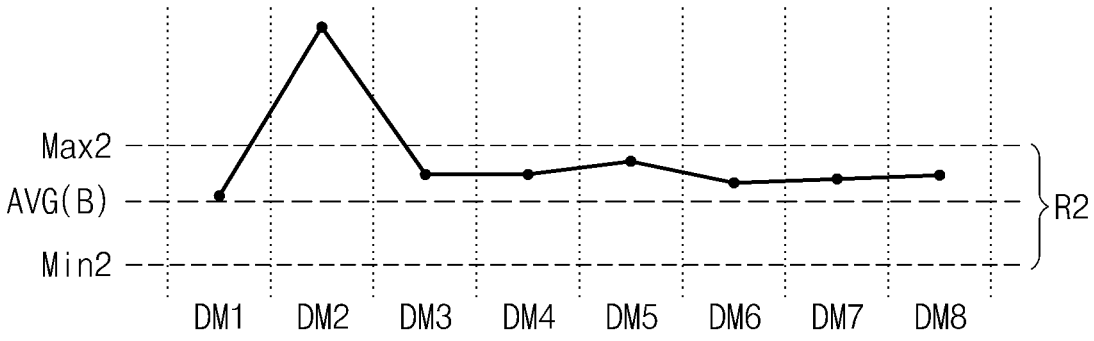
FIG. 5B is a graph showing maximum gray-scale values of the first to eighth dimming areas according to an exemplary embodiment of the present invention.

FIG. 5A is a graph showing the average gray-scale values of the first to eighth dimming areas according to an exemplary embodiment of the present invention, and FIG. 5B is a graph showing the maximum gray-scale values of the first to eighth dimming areas according to an exemplary embodiment of the present invention. In FIGS. 5A and 5B, the same reference numerals may denote the same or similar elements as in FIGS. 4A and 4B.

As shown in FIG. 5A, according to an exemplary embodiment of the present invention, all of the average gray-scale values of the first to eighth dimming areas DM1~DM8 are within the first reference range R1. According to an embodiment, in the case that a reference number is set to three, the comparing/checking part 272 outputs a first result signal res1 in a low state.

Referring to FIG. 5B, one of the maximum gray-scale values of the first to eighth dimming areas DM1~DM8 departs from the second reference range R2. According to an embodiment, in the case that a reference number is set to three, the comparing/checking part 272 outputs a second result signal res2 in a low state.

When both of the first and second result signals res1 and res2 are in the low state, the representative brightness value deciding part 273 calculates the first to eighth representative brightness values Lum1~Lum8 using the second parameter α2 having a value smaller than a value of the first parameter α1.

Figure 6:
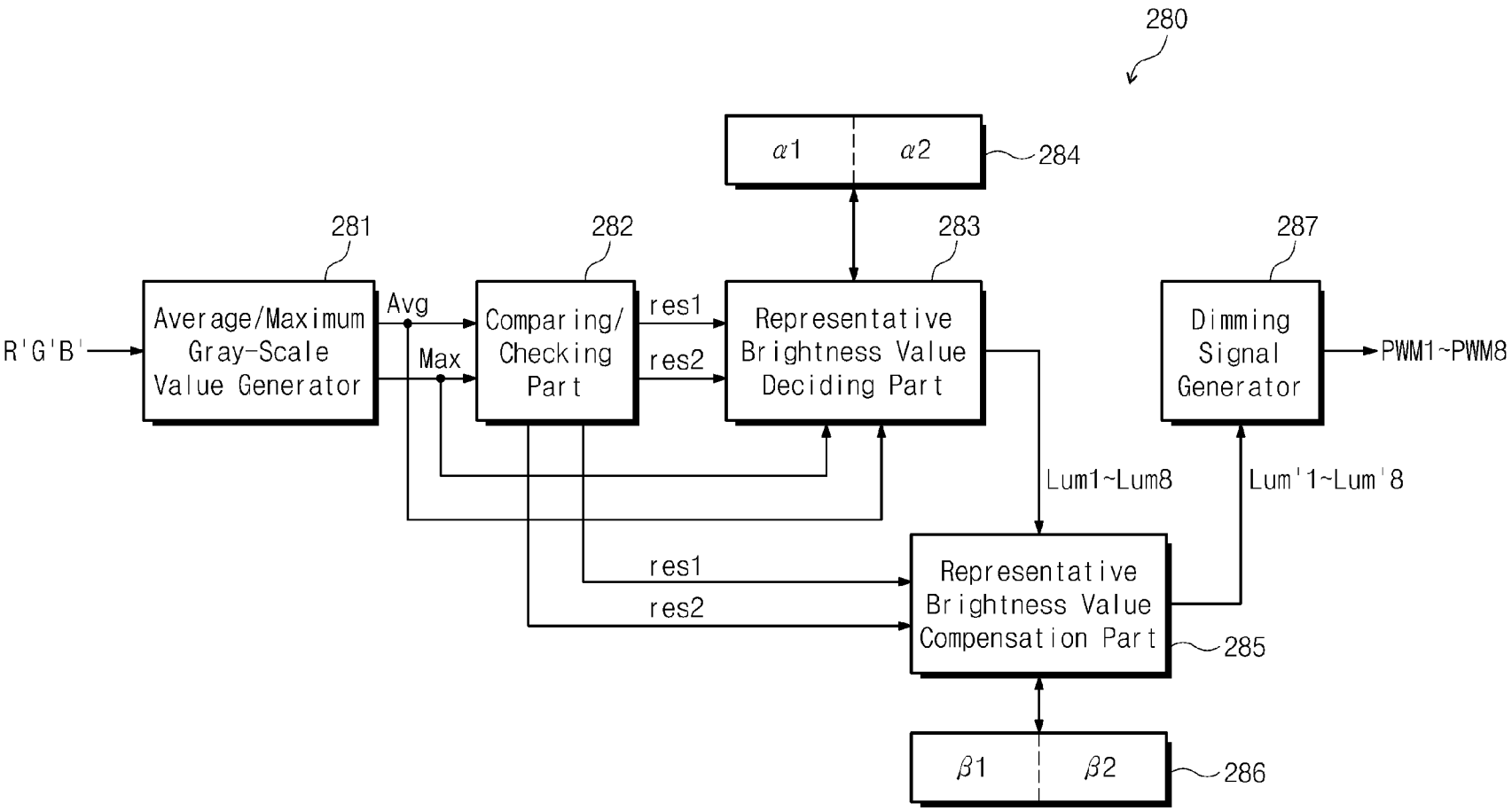
FIG. 6 is a block diagram showing a dimming device according to an exemplary embodiment of the present invention.

FIG. 6 is a block diagram showing a dimming device according to an exemplary embodiment of the present invention.

Referring to FIG. 6, a dimming device 280 includes an average/maximum gray-scale value generator 281, a comparing/checking part 282, a representative brightness value deciding part 283, a first storing part 284, a representative brightness value compensation part 285, a second storing part 286, and a dimming signal generator 287.

The average/maximum gray-scale value generator 281, the comparing/checking part 282, and the representative brightness value deciding part 283 perform the same functions as functions of the average/maximum gray-scale value generator 271, the comparing/checking part 272, and the representative brightness value deciding part 273, respectively, as shown in FIG. 3.

According to an embodiment, the representative brightness value compensation part 285 may be a spatial compensation part that filters first to eighth representative brightness values Lum1~Lum8 respectively corresponding to first to eighth dimming areas DM1~DM8 with a low-pass filter. First, the representative brightness value compensation part 285 extracts a dimming area having a maximum representative brightness value. Then, as a distance between the extracted dimming area and the first to eighth dimming areas DM1~DM8 increases, the representative brightness value compensation part 285 gradually decreases the first to eighth representative brightness values Lum1~Lum8 of the first to eighth dimming areas DM1~DM8 by a spatial parameter with reference to the maximum representative brightness value.

As an example, the spatial parameter may include one of a third parameter β1 and a fourth parameter β2, which have different values from each other. According to an embodiment, the spatial parameter may be a predetermined number larger than 0 and smaller than 1.

According to an exemplary embodiment, the second storing part 286 stores the third and fourth parameters β1 and β2. According to an embodiment, the second storing part 286 may use a portion of an EEPROM included in the timing controller 220 to store the third and fourth parameters β1 and β2.

As shown in FIG. 6, the representative brightness value compensation part 285 receives the first and second result signals res1 and res2 from the comparing/checking part 282. The representative brightness value compensation part 285 selects the third parameters having a smaller value than a value of the fourth parameters β2 when at least one of the first and second result signals res1 and res2 is in a high state and selects the fourth parameter β2 having a larger value than a value of the third parameter β2 when both of the first and second result signals res1 and res2 are in a low state.

The representative brightness value compensation part 285 compensates for the first to eighth representative brightness values Lum1~Lum8 based on the selected parameter to output first to eighth brightness compensation values Lum'1~Lum'8. The first to eighth brightness compensation values Lum'1~Lum'8 are provided to the dimming signal generator 287. The dimming signal generator 287 generates first to eighth dimming signals PWM1~PWM8 based on the first to eighth brightness compensation values Lum'1~Lum'8.

Figure 7:
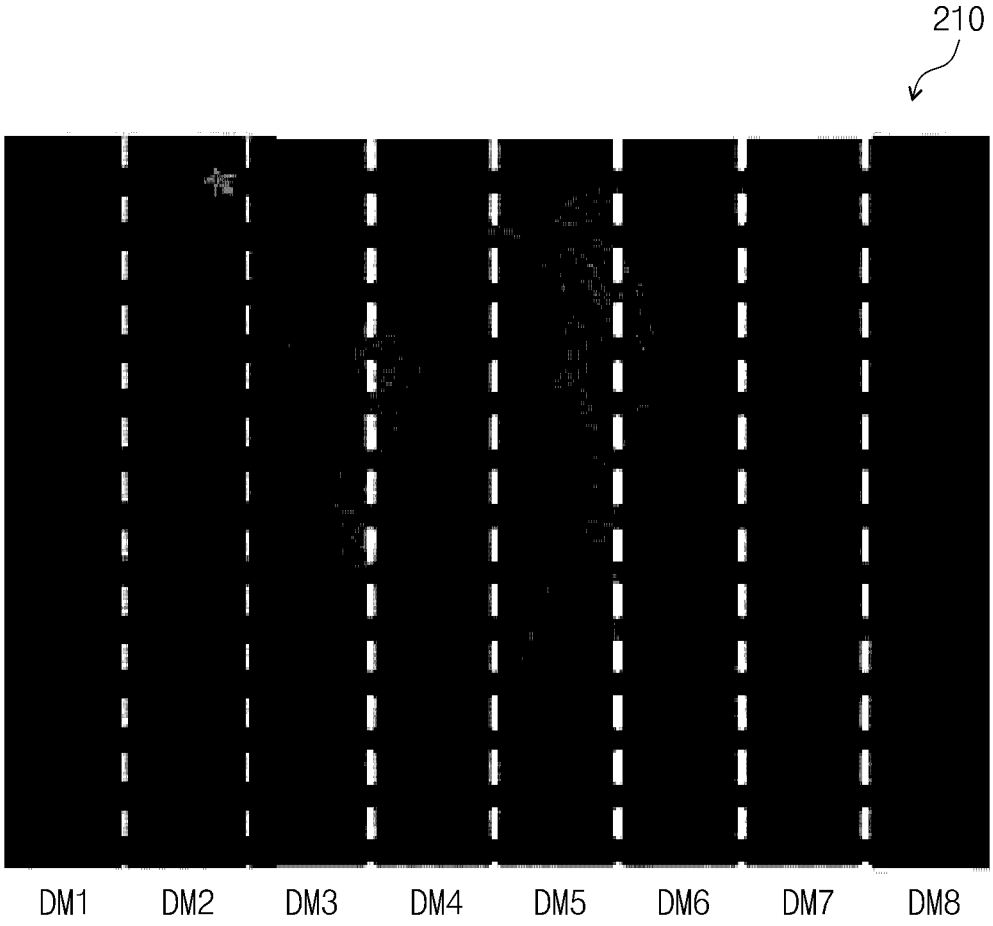
FIG. 7 is a view showing an image displayed on a liquid crystal display panel according to an exemplary embodiment of the present invention.
Figure 8:
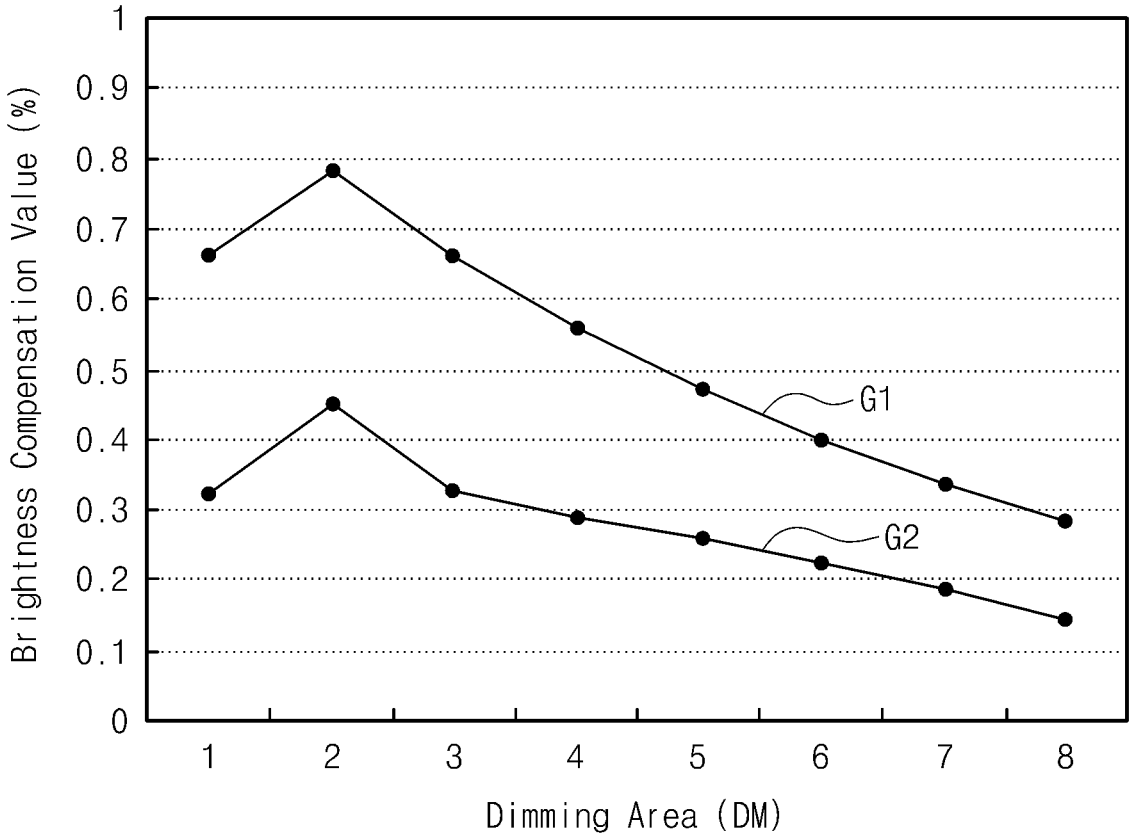
FIG. 8 is a graph showing representative brightness values of the first to eighth dimming areas of FIG. 7.

FIG. 7 is a view showing an image displayed on a liquid crystal display panel according to an exemplary embodiment of the present invention. FIG. 8 is a graph showing representative brightness values of first to eighth dimming areas of FIG. 7. Referring to FIG. 8, a first graph G1 represents the first to eighth brightness compensation values in the case that the third parameter is selected, and a second graph G2 represents the first to eighth brightness compensation values in the case that the fourth parameter is selected.

Referring to FIG. 7, a dark image is displayed on the entire liquid crystal display panel 210 and a portion where a star is positioned is brightly displayed. The star is positioned in the second dimming area DM2 among the first to eighth dimming areas DM1~DM8. The average gray-scale values Avg and the maximum gray-scale values Max of the first to eighth dimming areas DM1=DM8 are shown in the following Table 1. According to Table 1, the average gray-scale values Avg and the maximum gray-scale values Max are within a range of 0 to 255 gray-scales.

TABLE 1

| | | | | | | | | |
|---|---|---|---|---|---|---|---|---|
| Average gray-scale values (Avg) | 20 | 22 | 21 | 21 | 23 | 22 | 22 | 22 |
| Maximum gray-scale values (Max) | 30 | 250 | 33 | 35 | 38 | 30 | 32 | 32 |

As shown in Table 1, the average gray-scale values Avg of the first to eighth dimming areas DM1~DM8 are similar to each other within the range of about 20 to about 23. The maximum value of the maximum gray-scale values Max is shown in the second dimming area DM2 in which a difference between the maximum gray-scale value Max and the average gray-scale value Avg is more than 200 gray-scales.

Table 2 shows representative brightness values calculated using the first parameter, and Table 3 shows representative brightness values calculated using the second parameter. Table 2 also shows brightness compensation values calculated using the third parameter, and Table 3 also shows brightness compensation values calculated using the fourth parameter. Referring to FIG. 8, a y-axis denotes ratios of the brightness compensation values to 256 gray-scales.

TABLE 2

| | | | | | | | | |
|---|---|---|---|---|---|---|---|---|
| Average gray-scale values (Avg) | 20 | 22 | 21 | 21 | 23 | 22 | 22 | 22 |
| Maximum gray-scale values (Max) | 30 | 250 | 33 | 35 | 38 | 30 | 32 | 32 |
| Representative brightness value | 27.8 | 99.84 | 30.36 | 31.92 | 34 | 28.24 | 29.8 | 29.8 |
| Brightness compensation value | 168.62 | 199.84 | 168.62 | 142.27 | 120.04 | 101.28 | 85.458 | 72.105 |

TABLE 3

| | | | | | | | | |
|---|---|---|---|---|---|---|---|---|
| Average gray-scale values (Avg) | 20 | 22 | 21 | 21 | 23 | 22 | 22 | 22 |
| Maximum gray-scale values (Max) | 30 | 250 | 33 | 35 | 38 | 30 | 32 | 32 |
| Representative brightness value | 23 | 90.4 | 24.6 | 25.2 | 27.5 | 24.4 | 25 | 25 |
| Brightness compensation value | 84.75 | 90.4 | 84.75 | 79.453 | 74.487 | 69.382 | 65.467 | 61.376 |

According to Table 2 and the first graph G1 of FIG. 8, when the first to eighth representative brightness values Lum1~Lum8 of the first to eighth dimming areas DM1~DM8 are calculated by using the first parameter α1, the second representative brightness value Lum 2 has a highest value. According to Equation 1, the first parameter α1 is about 0.78.

Then, the first to eighth brightness compensation values Lum'1~Lum'8 are calculated by using the third parameter β1. For example, the first brightness compensation value Lum'1 of the first dimming area DM1 has a value corresponding to about 84.37% of the second representative brightness value of the second dimming area DM2 (for example, a highest representative brightness value). The third parameter β1 has a value of about 0.8437.

According to an embodiment, the third to eighth brightness compensation values Lum'3~Lum'8 of the third to eighth dimming areas DM3~DM8 may have a value that is smaller than the second representative brightness value Lum2 by a value obtained by multiplying the third parameter β1 by a distance weight. As used herein, the term "distance weight" refers to a predetermined value which decreases depending on a distance from a dimming area having a highest representative brightness value. As a result, the third to eighth brightness compensation values Lum'3~Lum'8 may be gradually decreased as a distance from the second dimming area DM2 increases.

According to Table 3 and the second graph G2 of FIG. 8, the first to eighth representative brightness values Lum1~Lum8 of the first to eighth dimming areas DM1~DM8 are calculated using the second parameter α2. According Equation 1, the second parameter α2 is about 0.299. As a result, the first to eighth representative brightness values Lum1~Lum8 are lower when the second parameter α2 is used than when the first parameter α1 is used.

Then, the first to eighth brightness compensation values Lum'1~Lum'8 are calculated using the fourth parameter β2. For example, the first brightness compensation value Lum'1 has a value corresponding to about 93.75% of the second representative brightness value of the second dimming area DM2 (for example, a highest representative brightness value). The fourth parameter β2 has a value of about 0.9375. The third to eighth brightness compensation values Lum'3~Lum'8 of the third to eighth dimming areas DM3~DM8 may have a value that is smaller than the second representative brightness value Lum2 by a value obtained by multiplying the fourth parameter β2 by a distance weight. As a result, the third to eighth brightness compensation values Lum'3~Lum'8 may be gradually decreased as a distance from the second dimming area DM2 increases.

When the brightness compensation values are extracted using the second and fourth parameters, the power consumption is reduced by about 43% compared to when the brightness compensation values are extracted using the first and third parameters.

When most of the data are distributed in a gray-scale range of 20 to 40, for example, low gray-scales, but some data in a dimming area has a grayscale of 250, for example, a high gray-scale, (for example, when both of the first and second result signals res1 and res2 are generated in the low state), the power consumption may be more reduced by generating the brightness compensation values using the second and fourth parameters α2 and β2.

Figure 9:
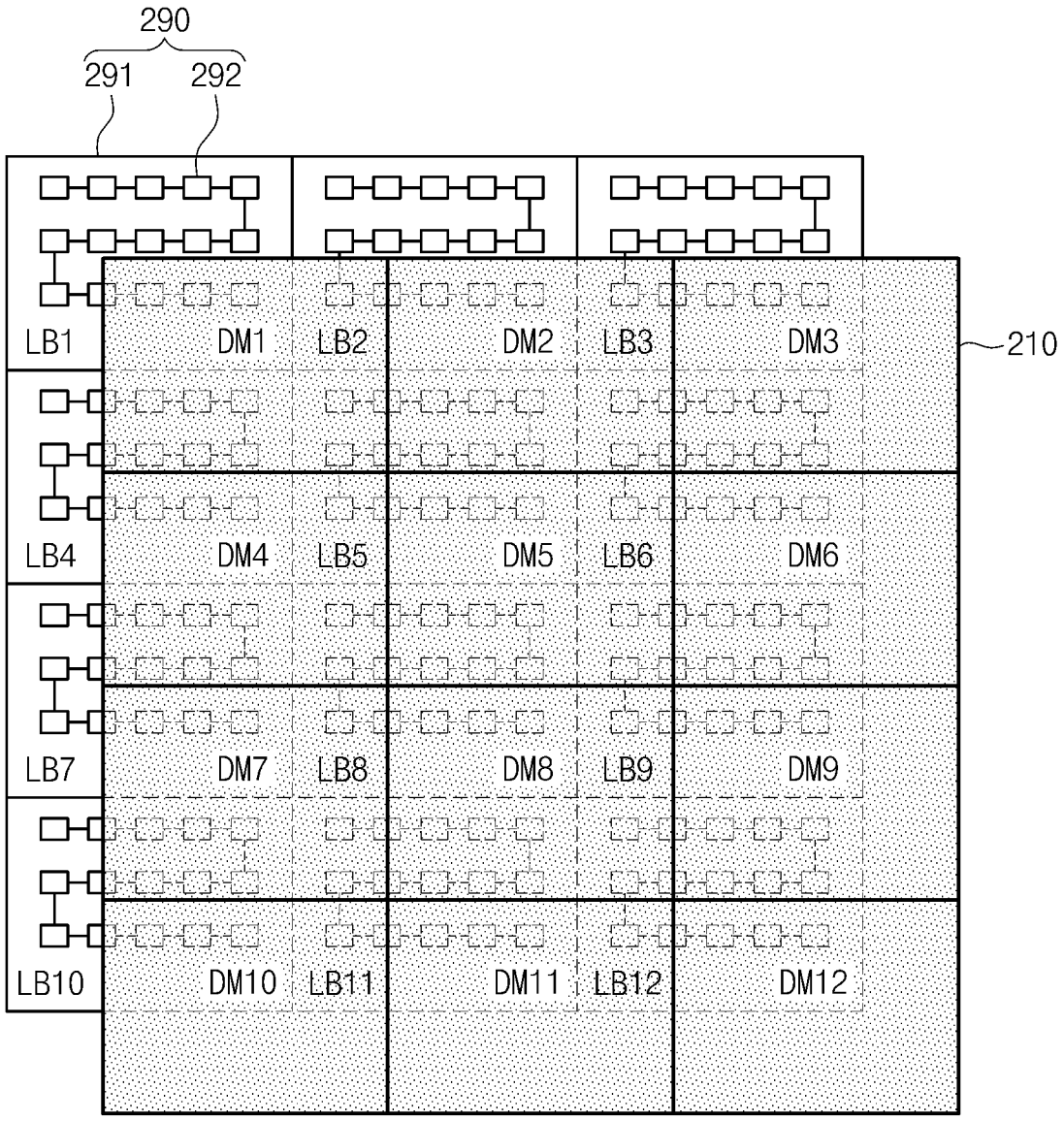
FIG. 9 is a plan view showing a backlight device according to an exemplary embodiment of the present invention.

FIG. 9 is a plan view showing a backlight device according to another exemplary embodiment of the present invention.

Referring to FIG. 9, a backlight device 290 has a two-dimensional local dimming structure in which light source blocks are divided into two different directions. For example, the backlight device 290 includes a circuit board 291 and a plurality of light source blocks LB1~LB12 arranged on the circuit board 291. According to an exemplary embodiment, the light source blocks LB1~LB12 are arranged in a 3 by 4 matrix configuration.

Each of the light source blocks LB1~LB12 may include a plurality of light sources 292. According to an embodiment, each of the light sources 292 may be a light emitting diode.

According to an embodiment, the dimming device 270 shown in FIG. 1 may be applied to the two-dimensional local dimming structure.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A method of controlling a backlight device comprising a plurality of light source blocks respectively corresponding to a plurality of dimming areas of a display panel, the method comprising:

outputting average gray-scale values and maximum gray-scale values for the respective dimming areas based on image signals provided to the display panel;

outputting result signals determining whether the average gray-scale values are within a first reference range and whether the maximum gray-scale values are within a second reference range;

outputting representative brightness values for the respective dimming areas based on one selected from predetermined two or more parameters, wherein the selected parameter is based on the result signals; and determining duty ratios of the respective light source blocks based on the representative brightness values, wherein the first reference range is determined based on an average value of the average gray-scale values, and the second reference range is determined based on an average value of the maximum gray-scale values.

2. The method of claim 1, further comprising:

calculating the number of the average gray-scale values departing from the first reference range; and checking whether the number of the average gray-scale values departing from the first reference range exceeds a predetermined first reference value to output a first result signal.

3. The method of claim 2, further comprising:

calculating the number of the maximum gray-scale values departing from the second reference range; and checking whether the number of the maximum gray-scale values departing from the second reference range exceeds a predetermined second reference value to output a second result signal.

4. The method of claim 3, wherein the at least two parameters comprise a first parameter and a second parameter having a smaller value than a value of the first parameter, and wherein when at least one of the first and second result signals is in a high state, the first parameter is selected, and wherein both of the first and second result signals are in a low state, the second parameter is selected.

5. The method of claim 4, wherein the representative brightness values satisfy the following equation, $Lum=Avg+(Max-Avg)\times\alpha$, where Avg denotes an average gray scale value, Max denotes a maximum gray-scale value, and a denotes the selected parameter.

6. The method of claim 5, wherein each of the first and second parameters has a value that is larger than 0 and smaller than 1.

7. The method of claim 1, further comprising:

extracting a dimming area having a maximum representative brightness value among the representative brightness values corresponding to the dimming areas, respectively; and calculating a distance weight of each of the dimming areas using a distance between each of the dimming areas and the extracted dimming area and converting the representative brightness values of the dimming areas to brightness compensation values using one selected from at least two spatial parameters and the calculated distance weight to output the brightness compensation values.

8. The method of claim 7, wherein the at least two spatial parameters comprise a first spatial parameter and a second spatial parameter having a value larger than a value of the first spatial parameter, and wherein when at least one of the first and second result signals is in a high state, the first spatial parameter is selected, and when both of the first and second result signals are in a low state, the second spatial parameter is selected.

9. The method of claim 7, wherein a duty ratio of each of the light source blocks is determined according to the brightness compensation value.

10. A display apparatus comprising:

a display panel divided into a plurality of dimming areas;

a backlight device including a plurality of light source blocks, each having a plurality of light sources, wherein the plurality of light source blocks respectively correspond to the dimming areas;

a dimming device outputting dimming signals using image signals provided to each of the dimming areas; and a light source driver outputting driving signals to the light source blocks based on the dimming signals, wherein the dimming device comprises:

an average/maximum gray-scale value generator extracting a plurality of gray-scale values from the image signals, averaging the plurality of gray-scale values to generate average gray-scale values of the respective dimming areas, and extracting maximum values of the gray-scale values to generate maximum gray-scale values of the respective dimming areas;

a comparing/checking part checking whether the average gray-scale values are within a first reference range and checking whether the maximum gray-scale values are within a second reference range;

a representative brightness value deciding part selecting one from at least two parameters according to a checked result and determining representative brightness values corresponding to the dimming areas using the selected parameter; and a dimming signal generator outputting the dimming signals to determine the duty ratios of the light source blocks based on the representative brightness values, wherein the first reference range is determined based on an average value of the average gray-scale values and the second reference range is determined based on an average value of the maximum gray-scale values.

11. The display apparatus of claim 10, wherein the comparing/checking part calculates the number of the average gray-scale values departing from the first reference range and checks whether the number of the gray-scale values departing from the first reference range is larger than a predetermined reference number to output a first result signal, and the comparing/checking part calculates the number of the maximum gray-scale values departing from the second reference range and checks whether the number of maximum gray-scale values departing from the second reference range is larger than a predetermined reference number to output a second result signal.

12. The display apparatus of claim 11, wherein the at least two parameters comprise a first parameter and a second parameter having a smaller value than a value of the first parameter, and wherein when at least one of the first and second result signals is in a high state, the first parameter is selected, and wherein both of the first and second result signals are in a low state, the second parameter is selected.

13. The display apparatus of claim 10, wherein the representative brightness values satisfy the following equation, $Lum=Avg+(Max-Avg)\times\alpha$, where Avg represents an average gray-scale value, Max represents a maximum gray-scale value, and $\alpha$ represents the selected parameter.

14. The display apparatus of claim 13, wherein each of the first and second parameters has a value that is larger than 0 and smaller than 1.

15. The display apparatus of claim 10, further comprising:

a representative brightness value compensation part that filters the representative brightness values of the dimming areas with a low-pass filter to convert the representative brightness values into brightness compensation values of the dimming areas and outputs the brightness compensation values.

16. The display apparatus of claim 15, wherein the representative brightness value compensation part extracts a dimming area having a maximum representative brightness value among the representative brightness values of the dimming areas, calculates a distance weight of each of the dimming areas using a distance between each of the dimming areas and the extracted dimming area, and generates the brightness compensation values of the dimming areas using one selected from at least two spatial parameters and the calculated distance weight to output the brightness compensation values.

17. The display apparatus of claim 16, wherein the at least two spatial parameters comprise a first spatial parameter and a second spatial parameter having a value that is larger than a value of the first spatial parameter, and wherein when at least one of the first and second result signals is in a high state, the first spatial parameter is selected, and when both of the first and second result signals are in a low state, the second spatial parameter is selected.

18. The display apparatus of claim 15, wherein the dimming signal generator generates the dimming signals based on the brightness compensation values of the dimming areas.

* * * * *